US009972291B2

(12) United States Patent
Simonek

(10) Patent No.: US 9,972,291 B2
(45) Date of Patent: May 15, 2018

(54) DRUM APPARATUS AND METHOD OF USE

(71) Applicant: Daniel Lee Simonek, San Marcos, CA (US)

(72) Inventor: Daniel Lee Simonek, San Marcos, CA (US)

( * ) Notice: Subject to any disclaimer, the term of this patent is extended or adjusted under 35 U.S.C. 154(b) by 0 days. days.

(21) Appl. No.: 15/606,755

(22) Filed: May 26, 2017

(65) Prior Publication Data

US 2017/0263221 A1 Sep. 14, 2017

Related U.S. Application Data

(63) Continuation of application No. 15/215,966, filed on Jul. 21, 2016, now Pat. No. 9,666,170, which is a continuation of application No. 14/881,137, filed on Oct. 12, 2015, now Pat. No. 9,406,286.

(60) Provisional application No. 62/063,821, filed on Oct. 14, 2014.

(51) Int. Cl.
*G10D 13/02* (2006.01)

(52) U.S. Cl.
CPC ..... *G10D 13/02* (2013.01); *G10D 13/022* (2013.01); *G10D 13/025* (2013.01)

(58) Field of Classification Search
CPC .. G10D 13/022; G10D 13/025; G10D 13/028; G10D 13/02
See application file for complete search history.

(56) References Cited

U.S. PATENT DOCUMENTS 1,109,903 A * 9/1914 Cruver et al. ..... G10D 13/02 84/420
1,385,898 A * 7/1921 Angyal ..... G10D 13/02 84/291
1,914,652 A * 6/1933 Stoer ..... G10D 13/02 84/420
1,932,968 A * 10/1933 Hiers ..... G10D 13/02 84/420
2,198,406 A * 4/1940 Deans ..... G10D 13/022 84/411 M
2,837,002 A * 6/1958 Susser ..... A61M 5/00 84/170
D212,172 S 9/1968 Lewis
(Continued)

FOREIGN PATENT DOCUMENTS

GB 2528280 A * 1/2016 ..... G10D 13/065

*Primary Examiner* — Robert W Horn
(74) *Attorney, Agent, or Firm* — Lodestone Legal Group; Jeromye V. Sartain

(57) ABSTRACT

A drum apparatus comprising at least a front wall, a snare bar rotatably installed substantially parallel to and offset from the front wall inner surface and having at least one snare wire extending substantially vertically therefrom so as to be adjacent to and selectively in contact with the front wall inner surface, and a rocker assembly comprising a lever mechanically coupled to the snare bar at a first end of the lever and further comprising an actuator leg pivotally coupled to and extending downwardly from an opposite second end of the lever pivotally installed within the drum apparatus on a support post coupled to the lever intermediate the first and second ends thereof, whereby the drum apparatus is shifted between first and second operational modes by selectively positioning the drum apparatus either substantially flat or tipped back so as to raise or lower the actuator leg.

25 Claims, 10 Drawing Sheets

(56) References Cited

U.S. PATENT DOCUMENTS

| | | | | |
|---|---|---|---|---|
| 4,256,006 | A | 3/1981 | Widener | |
| 4,402,248 | A * | 9/1983 | Pearce | G10D 13/02 84/411 R |
| 4,457,202 | A | 7/1984 | DeBarbrie | |
| 5,280,742 | A | 1/1994 | Vergara | |
| 5,385,075 | A | 1/1995 | Carnes | |
| 7,365,258 | B1 * | 4/2008 | Lombardi | G10D 13/006 84/422.1 |
| 7,482,522 | B2 * | 1/2009 | Wening | G10D 13/02 84/411 R |
| 7,485,790 | B2 | 2/2009 | Payerl | |
| 7,488,882 | B2 * | 2/2009 | Curet Troche | G10D 13/02 84/411 R |
| 7,692,083 | B2 * | 4/2010 | Aspland | G10D 13/006 84/411 R |
| 7,816,596 | B2 * | 10/2010 | Bottger | G10D 13/02 84/411 R |
| 8,115,088 | B2 | 2/2012 | Herrera | |
| 8,350,138 | B2 * | 1/2013 | Schmader | G10D 13/021 84/411 R |
| 8,487,170 | B2 | 7/2013 | Klein | |
| 8,829,321 | B2 | 9/2014 | Klein | |
| 8,884,145 | B1 * | 11/2014 | Lin | G10D 13/02 84/422.1 |
| 9,208,760 | B2 | 12/2015 | Drushal et al. | |
| 9,230,522 | B1 | 1/2016 | Lin | |
| 9,263,010 | B2 * | 2/2016 | Trask | G10D 13/025 |
| 2007/0234873 | A1 | 10/2007 | Lane | |
| 2009/0013849 | A1 | 1/2009 | Payerl | |
| 2016/0329034 | A1 * | 11/2016 | Simonek | G10D 13/025 |

* cited by examiner

DRUM APPARATUS AND METHOD OF USE

RELATED APPLICATIONS

This is a continuation application and so claims the benefit pursuant to 35 U.S.C. § 120 of a prior filed and co-pending U.S. Non-Provisional patent application Ser. No. 15/215,966 filed Jul. 21, 2016, and entitled "Drum Apparatus and Method of Use," which itself claims the benefit pursuant to 35 U.S.C. § 120 of a prior filed U.S. Non-Provisional patent application Ser. No. 14/881,137 filed Oct. 12, 2015, and entitled "Drum Apparatus and Method of Use," now U.S. Pat. No. 9,406,286 issued Aug. 2, 2016, which itself claims priority pursuant to 35 U.S.C. § 119(e) to and is entitled to the filing date of U.S. Provisional Patent Application Ser. No. 62/063,821 filed on Oct. 14, 2014, and entitled "Cajon/Box hand drums with multiple sounds adjusted by tilting/rocking the Cajon forward or back." The contents of the aforementioned applications are incorporated by reference herein.

BACKGROUND

The subject of this patent application relates generally to drums, and more particularly to cajón or box style drums configured with improved features for a wider variety of sounds and convenience in playing.

Applicant hereby incorporates herein by reference any and all patents and published patent applications cited or referred to in this application.

By way of background, cajón drums are nominally six-sided, box-shaped percussion instruments played by slapping usually just the front face with the hands or fingers or sometimes other implements such as brushes, mallets, or sticks. Such cajón drums are typically of all wood construction, with particularly the played face or front wall made of relatively thin plywood, forming the striking surface and what is effectively the head of the drum. The other five sides may also be made of plywood of various thicknesses to produce the desired tones and resonance. All six sides are typically flat, again yielding a box-shaped drum. An internal box framework or support structure is first fashioned, again usually out of wood, to which the faces or sides are attached as by nails or screws or simply wood glue. Most often, at least the front face is not glued or nailed but attached by screws at various points, with the screws enabling "tuning" of the front face or head so as to get the desired tone or resonance as well as more convenient removal of the front face for replacement as needed or access to the interior of the drum for any repairs or enhancements. Typically a round, substantially centered air or sound hole is provided in the back face or wall of the drum generally to allow the sound out and for further acoustic effects. Most often the cajón drum is played while seated on it in a somewhat straddle fashion and reaching down to strike the front face or head. As such, the top side of the drum serves as a seat and so while made of wood may also include a padded cover or the like for comfort.

As an added feature of some cajón drums, snare wires may be installed within the drum so as to be in contact with the inside surface of the front face or head, usually near the top of the drum where the higher tones are played more like the tones of a conventional snare drum. In some cases the wires are installed in a traditional fashion as in any snare drum, including snare wires, snare holder, strainer, and strainer holder, all installed vertically adjacent the inside surface of the front face. In such an installation, then, the snare feature is "always on." Similarly, for both adjustability and as an alternative installation arrangement, the snare wires may be installed extending upwardly on a round wooden dowel or the like that is rotatably installed in a horizontal fashion as suspended between the sides of the drum adjacent and substantially parallel to the inside surface of the front face, with a cord or the like running from the wooden dowel to a turnbuckle installed at the back of the drum and accessible through the sound hole so as to adjust the snare (tighten or loosen the tension on the dowel and thus the degree of pressure of the wires against the inside surface of the front face. While the turnbuckle can be completely loosened so as to pivot the snare wires out of contact with the front face and so turn the snare "off," the practical implication of this alternative installation is also an "always on" snare feature, here simply being adjustable like tuning a conventional drum head so as to obtain a desired tone or "buzz-like effect" from the snare. In other cases it is desired that the snare feature only be selectively "on" and so be capable of being turned "on" and "off." In one approach external knobs accessible on the outside of the cajón are engaged with the wooden snare dowel on opposite ends through holes in the drum sides—one knob integral with the dowel and so rotating the dowel so that the snares wires are brought into or out of contact with the inside surface of the front face as the knob is rotated, and the opposite knob turning independent of the dowel and so serving to selectively tighten and pull the dowel into contact with the intermediate side wall and so prevent the dowel's rotation once in the desired position, thereby selectively locking the cajón drum in the "snare on" or "snare off" position. Other similar arrangements have been proposed whereby the snare is turned "on" and "off" by adjusting one or more knobs on the side(s) of the cajón so as to rotate the dowel on which the snare wires are affixed, directly or through a lever. In still other arrangements an external pedal may be operably connected to the snare assembly so as to selectively turn the snare "on" and "off," such as "on" when the pedal is depressed and "off" when it is not.

Other percussion sounds have been incorporated into cajón drums beyond the snare wires or other cords, guitar strings or the like to create a desired "buzz like sound." For example, bells or rattles on a looped wire or string may be loosely suspended adjacent the front face for an additional sound when the front face is struck, particularly immediately adjacent to the location of the bells or rattles.

In all such cajón drums with additional percussion sounds incorporated, the range and selective playability of the percussion accents is often not what is desired or particularly convenient. For example, back to the snare feature, known approaches all have drawbacks, in terms of the snare either being "always on" or the mechanism that enables the snare to be selectively turned "off" not being readily operated while playing, requiring at least one hand and sometimes two in order to shift the snare wires as desired. As such, these mechanisms are really only practical "between songs" or basically when not playing the cajón. Even the external pedal operation of the snare is limiting on the player's body position and so not as convenient in use. As such, an improved box drum apparatus and method for selectively turning the snare feature "on" and "off" is still needed. Even the other percussion features that might be incorporated in a cajón drum such as bells are rattles are limited in their use and playability, only being able to sound the accent when striking or not striking a certain area of the face and so leading to potentially inadvertent or unwanted sounds simply by playing too close to where the percussion feature is located within the drum. Even the conventional rectangular "box" shape of cajón drums leaves something to be desired, and improvements to the resonance and tonal range are still needed as well as may be affected by the shape of the drum as well as the shape, size, and location of the sound hole(s).

Aspects of the present invention fulfill these needs and provide further related advantages as described in the following summary.

SUMMARY

Aspects of the present invention teach certain benefits in construction and use which give rise to the exemplary advantages described below.

The present invention solves the problems described above by providing a new and improved drum apparatus and method of use. In at least one embodiment, the drum apparatus comprises: at least a front wall having an inner surface and an opposite outer surface, the front wall having a front wall perimeter and defining a drum head that is played by selectively striking the front wall outer surface; a snare bar rotatably installed substantially parallel to and offset from the front wall inner surface, the snare bar having at least one snare wire extending substantially vertically therefrom so as to be adjacent to and selectively in contact with the front wall inner surface, the snare bar and at least one snare wire together defining a first percussion accessory of the drum apparatus; and a rocker assembly for selectively operating the first percussion accessory, the rocker assembly comprising a lever mechanically coupled to the snare bar at a first end of the lever and further comprising an actuator leg pivotally coupled to and extending downwardly from an opposite second end of the lever so as to be directed toward a ground surface on which the drum apparatus may be positioned, the lever being pivotally installed within the drum apparatus on a support post coupled to the lever intermediate the first and second ends thereof; whereby the drum apparatus is shifted between first and second operational modes by selectively positioning the drum apparatus either substantially flat on the ground surface with the actuator leg in contact with the ground surface and so shifting the actuator leg upward or with the drum apparatus tipped back so as to raise the front wall away from the ground surface and shift the actuator leg downward, the movement of the actuator leg as acting on the second end of the lever thereby causing the lever to pivot about the support post so as to shift the first end of the lever up or down and toward or away from the front wall and thereby rotate the snare bar to shift the at least one snare wire away from and substantially out of contact with or toward and substantially into contact with the front wall inner surface, such that the first percussion accessory is selectively played when the front wall outer surface of the drum apparatus is struck based on the drum apparatus being in either the first or the second operational mode.

In a further aspect, the rocker assembly comprises a rocker spring connected to the lever and configured to bias the first end thereof toward the front wall and thus to bias the rocker assembly into the second operational mode with the actuator leg shifted downward and the snare bar rotated such that the at least one snare wire is substantially in contact with the front wall inner surface, whereby maintaining the rocker assembly in the first operational mode with the at least one snare wire shifted away from and substantially out of contact with the front wall inner surface is achieved by shifting the actuator leg upward and the first end of the lever away from the front wall against the biasing effect of the rocker spring as by positioning the drum apparatus substantially flat on the ground surface with the actuator leg in contact therewith.

In a still further aspect, the rocker assembly comprises a snare rod having a front end fixed to the snare bar and an opposite rear end engaged with the first end of the lever.

In a still further aspect, the lever has a substantially boomerang shape defining a substantially vertical first leg and a substantially horizontal second leg.

In a still further aspect, the drum apparatus comprises opposite, substantially upright side walls and a substantially horizontal top wall and an opposite, substantially horizontal bottom wall interconnected with the side walls and the front wall, the side walls being outwardly bowed in a plane substantially perpendicular to the front wall, whereby the front wall perimeter has outwardly curved left and right edges.

In a still further aspect, the drum apparatus comprises a rear wall substantially opposite and parallel to the front wall and having a rear wall perimeter substantially conforming to the front wall perimeter, the rear wall having a rear sound hole formed therein defining a rear sound hole opening having a shape selected from a circle, an ellipse, an oval, an egg, a nephroid, a folium, a teardrop, a triangle, a trefoil, a circular segment, an arch, a lens, and a stadium.

In a still further aspect, the drum apparatus comprises a slidable sound hole cover adjacent to the rear sound hole for selectively adjusting the size of the rear sound hole opening, whereby the rear sound hole may be left open or may be partially or fully closed.

In a still further aspect, the drum apparatus comprises a front sound hole formed at the base of the front wall.

In a still further aspect, the drum apparatus comprises a second percussion accessory operatively mounted in conjunction with an actuator rod slidably installed so as to extend from the front wall to an opposite rear wall of the drum apparatus, the actuator rod having at least one actuator spring configured to bias the actuator rod toward the front wall and further configured with an actuator knob positioned on the actuator rod offset from the front wall outer surface, whereby selectively striking the actuator knob temporarily shifts the actuator rod rearwardly against the biasing effect of the actuator spring so as to play the second percussion accessory.

In a still further aspect, the second percussion accessory is selected from the group consisting of a shaker mounted internally on the actuator rod, jingles mounted internally on a side wall of the drum apparatus so as to be selectively struck by a mallet mounted internally on the actuator rod offset from the jingles, and a block mounted externally on the rear wall of the drum apparatus so as to be selectively struck by a rear end of the actuator rod opposite the actuator knob.

In a still further aspect, the drum apparatus comprises a second percussion accessory configured as a cymbal mounted on a cymbal arm slidably received within a cymbal mount externally installed on an outer surface of a bottom wall of the drum apparatus so as to extend forwardly offset from the front wall thereof.

In a still further aspect, the drum apparatus comprises a plurality of sound dampening devices installed internally therein.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings:

FIG. 110 is a partial side schematic view thereof in a second operational mode, in accordance with at least one embodiment;

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION

Figure 1:
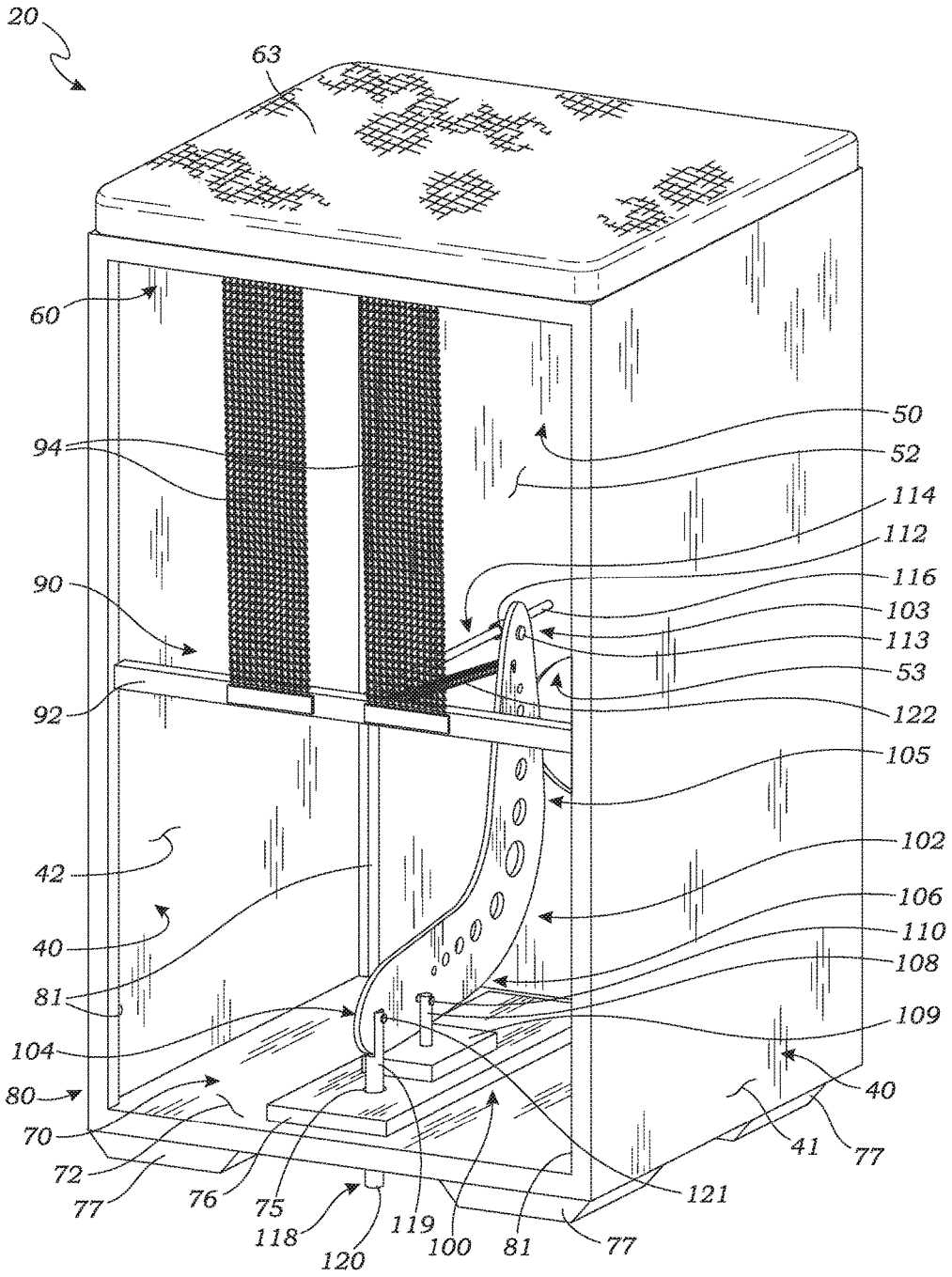
FIG. 1 is a partial front perspective view of an exemplary drum apparatus, in accordance with at least one embodiment.

Turning now to FIG. 1, there is shown a partial front perspective view of an exemplary embodiment of a drum apparatus 20 according to aspects of the present invention. The view is "partial" in that the front wall 30 (FIGS. 2 and 3) has been removed for convenient viewing of the interior of the drum apparatus 20. The apparatus 20 generally comprises, consistent with traditional cajón or box style drums, multiple walls or sides affixed to each other or to a support frame to literally form a six-sided box of a desired size, shape, and construction. As a threshold matter, and as will be appreciated from the present disclosure, the size, shape, and materials of construction of the drum apparatus 20 may vary widely to suit particular purposes and/or to employ materials and methods of construction or assembly now known or later developed, such that the drawings are to be understood as merely illustrative of features and aspects of the present invention and non-limiting. As shown, in the first exemplary embodiment, the drum apparatus 20 is formed having a front wall 30 (FIGS. 2 and 3), opposite side walls 40, a rear wall 50 opposite the front wall 30, and opposite top and bottom walls 60, 70 to complete the "box," with each such wall here shown as being substantially flat or planar and square to respective adjacent walls. In one representative embodiment, the overall size of the drum apparatus 20 is in the range of approximately eighteen to twenty-three inches (18-23 in.) tall, approximately fifteen to seventeen inches (15-17 in.) wide, and approximately fourteen to sixteen (14-16 in.) deep, with the front and rear walls 30, 50 made of relatively thin plywood—the front wall 30 on the order of a sixteenth to an eighth inch (1/16-1/8 in.) thick, which wall defines or forms the drum head that is played by selectively striking the front wall outer surface, though it will be appreciated that other sides may be played as well, and the rear wall on the order of an eighth to a quarter inch (1/8-1/4 in.) thick—and the side, top, and bottom walls 40, 60, 70 being made of relatively thicker plywood—particularly the top and bottom walls 60, 70 on the order of one half to three quarter inch (1/2-3/4 in.) thick, with the side walls ranging from one quarter to one half inch (1/4-1/2 in.) thick—though again it will be appreciated that all such dimensions and materials of construction are merely illustrative. Where an internal support framework 80 is employed in the drum apparatus 20, those skilled in the art will appreciate that the side walls 40, for example, can be relatively thinner as being relatively less load-bearing, which lends itself to modifying the shape of the side walls as discussed further below in connection with FIGS. 4 and 5. As known, additional reinforcing materials may be installed on the inner surfaces of one or more of the walls to support assembly and additional hardware to be mounted to the drum, such as feet 77. A padded or cushioned seat 63 may be installed on the upper or outer surface 61 (FIG. 2) of the top wall 60 for added comfort when seated on the drum apparatus 20 during use. Though only partially visible in FIG. 1, a rear sound hole 53 is formed within the rear wall 50, more about which is said below.

The exemplary drum apparatus 20 further comprises a first percussion accessory 90 here configured as a snare assembly. Particularly, the first percussion accessory 90 comprises a snare bar 92 rotatably installed substantially parallel to and offset from the front wall inner surface 32 (FIGS. 2 and 3), essentially spanning or extending between opposite side walls 40. More particularly, in the exemplary embodiment, the snare bar 92 is rotatably installed as on dowels, pins, or the like between opposite front vertical frame members 81 of the framework 80. Alternatively, the snare bar 92 may be rotatably or operably installed on one or both side walls 40 or even from the top wall 60. The snare bar 92 has at least one snare wire 94 extending substantially vertically therefrom so as to be adjacent to and selectively in contact with the front wall inner surface 32. In the illustrated embodiment, two groupings of multiple snare wires 94 are shown as being affixed to and standing upright substantially centered on the snare bar 92, in which case it will be appreciated that with the snare "on," more about which is said below in connection with FIGS. 2 and 3, striking anywhere in the middle of the upper half of the head or front wall 30 will play the snare, while playing lower on or at the marginal edges of the head 30 will generally not sound the snare even with it "on"—those skilled in the art will appreciate that different numbers and locations of the snare wires 94 beyond those shown and described so as to achieve different sounds from different areas of the drum head or front wall 30 are possible in the present invention without departing from its spirit and scope. As also shown in FIG. 1, the snare bar 92 is substantially square in cross-section or profile, thereby providing a relatively flat surface for mounting the one or more snare wires 94; however, it will be appreciated that the snare bar 92 may also have a circular or other cross-section, in whole or in part, while still accommodating the snare wires 94.

Figure 3:
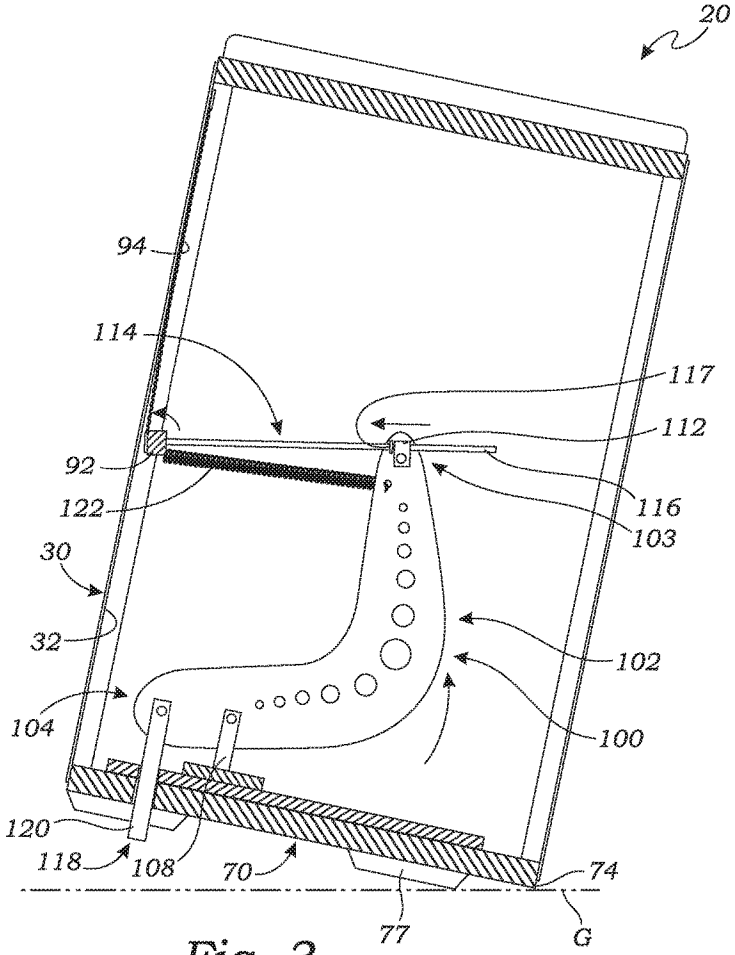
FIG. 3 is a side schematic view thereof in a second operational mode, in accordance with at least one embodiment.
Figure 2:
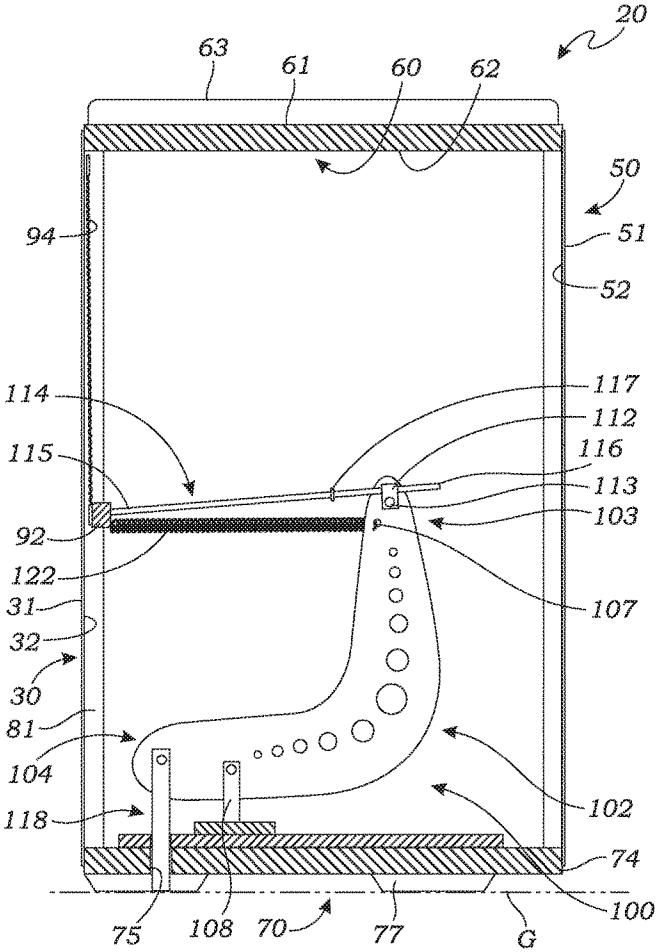
FIG. 2 is a side schematic view thereof in a first operational mode, in accordance with at least one embodiment.

With continued reference to FIG. 1, the drum apparatus 20 further comprises a rocker assembly 100 for selectively operating the first percussion accessory 90, the rocker assembly 100 comprising a lever 102 mechanically coupled to the snare bar 92 at a first end 103 of the lever 102. In the exemplary embodiment, the lever 102 is pivotally installed within the drum apparatus 20 in a substantially vertical orientation and substantially perpendicular to the front wall 30 (FIGS. 2 and 3). More particularly, the lever 102 is shown as having a somewhat boomerang shape defining a substantially vertical first leg 105 coterminous with the first end 103 and a substantially horizontal second leg 106 coterminous with the opposite second end 104 of the lever 102. The lever 102 is pivotally mounted on a support post 108 coupled to the lever 102 intermediate the first and second ends 103, 104 thereof as on a support post pivot pin 110, the support post 108 itself being affixed to a support post base 109. Regarding the coupling of the snare bar 92 to the pivoting lever 102, in the exemplary embodiment, a front end 115 (FIGS. 2 and 3) of a snare rod 114 is substantially rigidly fixed to the snare bar 92 and an opposite rear end 116 of the snare rod 114 is slidably engaged with the first end 103 of the lever 102. A slide loop 112 is pivotally installed on the first end 103 of the lever 102 as on a slide loop pivot pin 113, and the rear end 116 of the snare rod 114 is then slidably received within the slide loop 112 so as to enable raising and lowering the rear end 116 of the snare rod 114 as the lever 102 pivots somewhat arcuately, more about which is said below. At the opposite second end 104 of the lever 102, an actuator leg 118 is pivotally coupled and extends downwardly from the horizontal second leg 106 of the lever 102 so as to be directed toward a ground surface G (FIGS. 2 and 3) on which the drum apparatus 20 may be selectively positioned, the actuator leg 118 being attached at its top end 119 to the lever 102 as by an actuator leg pivot pin 121. Accordingly, the lever pivot-mount support post 108 is installed on the bottom wall 70 of the drum apparatus so as to extend upwardly therefrom and be coupled to the lever second leg 106 substantially offset from and parallel to the actuator leg 118. More particularly, the support post 108 is once again installed on a support post base 109, and in the exemplary embodiment, the support post base 109 is itself installed on a mounting block 76 installed on the bottom wall inner surface 72. Regarding the substantially axial movement of the actuator leg 118, there is further formed in the bottom wall 70, and in the exemplary embodiment through the mounting block 76 as well, a leg hole 75 within which the actuator leg 118 is configured to slidably operate. The actuator leg 118 is of sufficient length to selectively extend substantially perpendicularly from the bottom wall 70, or essentially having a free actuator leg bottom end 120 opposite the pivotally fixed top end 119, the bottom end 120 configured to extend downwardly from the bottom wall outer surface 71 and so be selectively engaged and thereby actuate the actuator leg 118 and in turn the lever 102 as by selectively contacting the ground surface G (FIGS. 2 and 3) with the bottom end 120 of the actuator leg 118. Those skilled in the art will again appreciate that while a particular geometric or kinematic arrangement of the rocker assembly 100 has been shown and described, the invention is not so limited, but may take a wide variety of other mechanical forms and arrangements now known or later developed according to aspects thereof.

Turning now to FIGS. 2 and 3, there are shown side schematic views of the exemplary drum apparatus 20 in respective first and second operational modes. Again, the drum apparatus 20 generally comprises a front wall 30 with a first percussion accessory 90 comprising a snare bar 92 rotatably installed substantially parallel to and offset from the front wall inner surface 32, with the opposite front wall outer surface 31 essentially being the face that is played. A rocker assembly 100 as above described is mechanically coupled to the snare bar 92 so as to effectively enable turning the snare feature "on" and "off." That is, the drum apparatus 20 is shifted between the first and second operational modes by selectively positioning the drum apparatus 20 either substantially flat on the ground surface G with the actuator leg 118 in contact with the ground surface G and so shifting the actuator leg 118 upward or with the drum apparatus 20 tipped back so as to raise the front wall 30 away from the ground surface G and shift the actuator leg 118 downward, the movement of the actuator leg 118 as acting on the second end 104 of the lever 102 thereby causing the lever 102 to pivot about the support post 108 so as to shift the first end 103 of the lever 102 up or down and toward or away from the front wall 30 and thereby rotate the snare bar 92 to shift the at least one snare wire 94 away from and substantially out of contact with or toward and substantially into contact with the front wall inner surface 32, such that the first percussion accessory 90 is selectively played when the front wall outer surface 31 of the drum apparatus 20 is struck based on the drum apparatus 20 being in either the first or the second operational mode. As shown in FIGS. 1-3, in the exemplary embodiment, the rocker assembly 100 further comprises a rocker spring 122 connected to the lever 102 and configured to bias the first end 103 thereof toward the front wall 30 and thus to bias the rocker assembly 100 into the second operational mode with the actuator leg 118 shifted downward and the snare bar 92 rotated such that the at least one snare wire 94 is substantially in contact with the front wall inner surface 32 as shown in FIG. 3. As such, it will be appreciated that the second operational mode is the "snare on" configuration of the drum apparatus 20 and that maintaining the rocker assembly 100 and thus the drum apparatus 20 in the first operational mode or the "snare off" position as shown in FIG. 2 with the at least one snare wire 94 shifted away from and substantially out of contact with the front wall inner surface 32 is achieved by shifting the actuator leg 118 upward and the first end 103 of the lever 102 away from the front wall 30 against the biasing effect of the rocker spring 122 as again by positioning the drum apparatus 20 substantially flat on the ground surface G with the actuator leg 118 in contact therewith. Those skilled in the art will appreciate once more that a variety of other arrangements are possible according to aspects of the present invention without departing from its spirit and scope. By way of example and not limitation, the arrangement could be configured to work substantially opposite, such that the first operational mode achieved when the drum is substantially flat on the ground is the "snare on" position and the "snare off" position to which the drum is instead biased as by a different arrangement of the rocker spring and/or the actuator leg and/or lever is achieved in the second operational mode with the drum tipped back. Other such arrangements are possible to suit a particular use or preference. The rocker spring 122 though shown as a coil spring may also be an elastic member or any other such memory material or member now known or later developed to provide a biasing function for the rocker assembly 100. In the exemplary embodiment, the rocker spring 122 is attached at one end in a spring mount hole 107 formed in the upper first end 103 or first leg 105 of the lever 102 with the opposite end fixed to the snare bar 92. Fundamentally, those skilled in the art will appreciate that in use the tremendous advantage of the drum apparatus 20 of the present invention, and particularly the rocker assembly 100 as operably engaged with the first percussion accessory 90 as again defining a snare device, is that the snare can be effectively turned "on" and "off" or its effects selected or adjusted even while playing the drum apparatus 20 or requiring any action by either of the player's hands, which at all times can be on or adjacent the front wall 30 even while the snare feature is selectively activated or deactivated, once again, simply by tipping or rocking the drum apparatus 20 in one direction or another, or from flat on the ground to tipped back to some extent.

Continuing with the exemplary embodiment of FIGS. 1-3 wherein the rocker assembly 100 is biased to the second operational mode or "snare on" position based on the configuration of the rocker spring 122, with reference to FIG. 2, in the first operational mode or "snare off" position with the drum apparatus 20 positioned substantially flat on the ground surface G with the actuator leg 118 in contact with the ground surface G, once more, the actuator leg 118 is shifted upward and so acts on the second end 104 of the lever 102, causing the lever 102 to pivot about the support post 108 against the biasing effect of the rocker spring 122 so as to shift the first end 103 of the lever 102 down and away from the front wall 30. Due to the slidable coupling of the snare rod 114 within the pivoting slide loop 112 at the lever upper end 103, as the upper end 103 shifts down and toward the rear, the rear end 116 of the snare rod 114 is lowered, thus causing a clockwise rotation of the snare bar 92, as viewed in FIG. 2, thereby shifting the at least one snare wire 94 away from and substantially out of contact with the front wall inner surface 32, such that the first percussion accessory 90 is not played when the front wall outer surface 31 of the drum apparatus 20 is struck. Notably, in the illustrated embodiment, in the "snare off" position of the drum apparatus 20 as shown in FIG. 2, the one or more snare wires 94 being substantially stiff though flexible stand substantially vertically and substantially parallel to but slightly offset from the front wall inner surface 32. By way of example but not limitation, the snare wires 94 may be approximately one quarter inch (¼ in.) from the front wall inner surface 32 at their base, adjacent the snare bar 92, and may be approximately one eighth inch (⅛ in.) from the front wall inner surface 32 at their tips, adjacent the top wall 60. Again, the rotation of the snare bar 92 even as having a substantially square or rectangular cross-section is achieved by mounting the snare bar 92 on dowels, pins, or the like so as to enable rotation, here as by placing such in holes formed in both the opposite ends of the snare bar 92 and in the inwardly-facing surfaces of the opposite front wall vertical frame members 81. It will be appreciated that the rotational position of the snare bar 92 and thus the spatial or angular position of the snare wires 94 as above-described is dictated by the geometric or kinematic arrangement of the rocker assembly 100, including but not limited to the size and shape of the lever 102 and of the support post 108, snare rod 114, and actuator leg 118. However, it will be appreciated that a virtually infinite number of combinations or configurations of such members is possible without departing from the spirit and scope of the invention, such that the invention is not limited to any particular geometric or kinematic arrangement, as shown and described or otherwise. With reference now to FIG. 3 showing the exemplary drum apparatus 20, and rocker system 100 particularly, in the default "snare on" position, it can again be seen that in the second operational mode with the drum apparatus 20 tipped back so as to lift the front wall 30 away from the ground surface G and allow the actuator leg 118 to shift downwardly due to the rotation of the lever 102 in the counterclockwise direction, as viewed in FIG. 3 and shown by the arrow, as biased by the rocker spring 122 connected to the first leg 105 of the lever 102 substantially at its first end 103, thereby shifting the second end 104 and thus the now free actuator leg 118 down and shifting the first end 103 up and toward the front wall 30. As a result, the rear end 116 of the snare rod 114 is raised, thus causing a counter-clockwise rotation of the snare bar 92, as viewed in FIG. 3, thereby shifting the at least one snare wire 94 toward and substantially into contact with the front wall inner surface 32, such that the first percussion accessory 90 is now played when the front wall outer surface 31 of the drum apparatus 20 is struck in the region of the snare wires 94. Here, in the illustrated embodiment, in the "snare on" position of the drum apparatus 20 as shown in FIG. 3, the one or more snare wires 94 again being substantially stiff but flexible are effectively bent against the front wall inner surface 32 so as to produce a snare or rattle sound when the front wall 30 is struck. By way of example and not limitation, approximately the upper or top fifty to seventy-five percent (50-75%) of the length of one or more snare wires 94 is brought into contact with the front wall inner surface 32 with the drum apparatus 20 in the second operational mode or "snare on" position. It will be appreciated by those skilled in the art that the degree of contact of the front wall inner surface 32 by the snare wires 94 is dependent on a number of factors, both in terms of the design of the rocker assembly 100, including the properties of the rocker spring 122 and the attributes, size, and orientation of the snare wires 94, as well as the extent to which the drum apparatus 20 is tipped back. Specifically, in the illustrated embodiment, when the drum apparatus 20 is fully tipped back as when it is resting on the ground surface G on only the two rear feet 77 and the bottom wall rear edge 74, so as to even take the actuator leg 118 completely out of contact with the ground surface G as shown in FIG. 3 or otherwise apply little to no upward force against the actuator leg 118, in which position the rocker spring 122 exerts its maximum or unopposed biasing force on the lever first end 103 and thus the snare bar 92 through the snare rod 114 so as to rotate the snare bar 92 to the extent possible against the bending resistance of the snare wires 94 themselves, thereby forcing and flexing the snare wires 94 against the front wall inner surface 32 to the extent possible for the particular drum apparatus 20 and rocker assembly 100 arrangement. Comparatively, when the drum apparatus 20 is tipped back but not fully such that the actuator leg 118 is in an intermediate position still in contact with the ground surface G but not shifted fully upwardly or downwardly, it will be appreciated that the effective force of the rocker spring 122 and thus of the snare wires 94 against the front wall inner surface 32 is reduced as by being offset by the intermediate counteracting force against the actuator leg 118 and thus the lever 102 and through it to the snare bar 92 and snare wires 94. As such, a range of snare effects is possible simply by adjusting the angle or degree of tilting the drum apparatus 20, again, advantageously all while the player is still playing the drum or otherwise without the need for either hand to be occupied with making any adjustments to the snare first percussion accessory 90. As one additional mechanism for adjusting or setting the snare, or the degree to which the snare wires 94 are bent or forced against the front wall inner surface 32, as shown in FIGS. 2 and 3, a mechanical or slide loop stop 117 may be positioned on the snare rod 114 so as to selectively contact the slide loop 112 installed at the top or first end 103 of the lever 102 and thereby limit the degree of slidable travel of the snare rod 114 within the slide loop 112 and thus the degree of rotation of the snare bar 92 and the degree of pressure exerted by the at least one snare wire 94 against the front wall inner surface 32. In the exemplary embodiment, the slide loop stop 117 is an o-ring frictionally secured in the desired location on the snare rod 114. It will be appreciated that positioning the o-ring stop 117 is an adjustment made to the drum apparatus 20 prior to playing much like adjusting the screws typically used to install the front wall 30 and thereby effectively "tune" the front wall or drum head of the drum apparatus 20. One further optional feature related to the sound produced by the snare accessory 90 is to apply a clear coat such as varnish or lacquer to the front wall inner surface 32, with such resulting relatively hard and smooth film against which the snare wires 94 vibrate when the front wall outer surface 31 is struck when playing the drum producing an even crisper buzz from the snare. As best seen in FIG. 2, the top wall 60 of the drum comprises an outer surface 61 on which the seat 63 is installed and an opposite inwardly- or downwardly-facing inner surface 62.

Figure 5:
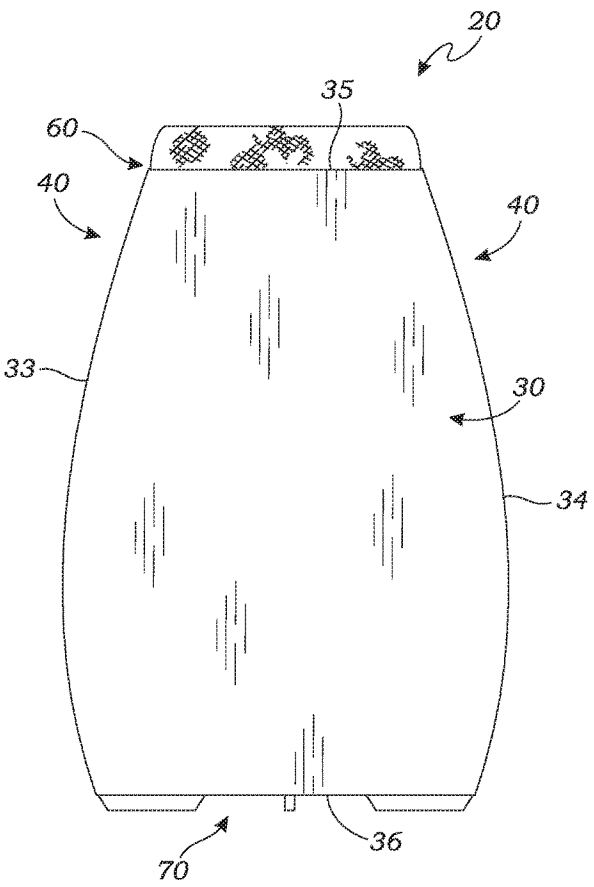
FIG. 5 is a reduced scale front view thereof, in accordance with at least one embodiment.
Figure 4:
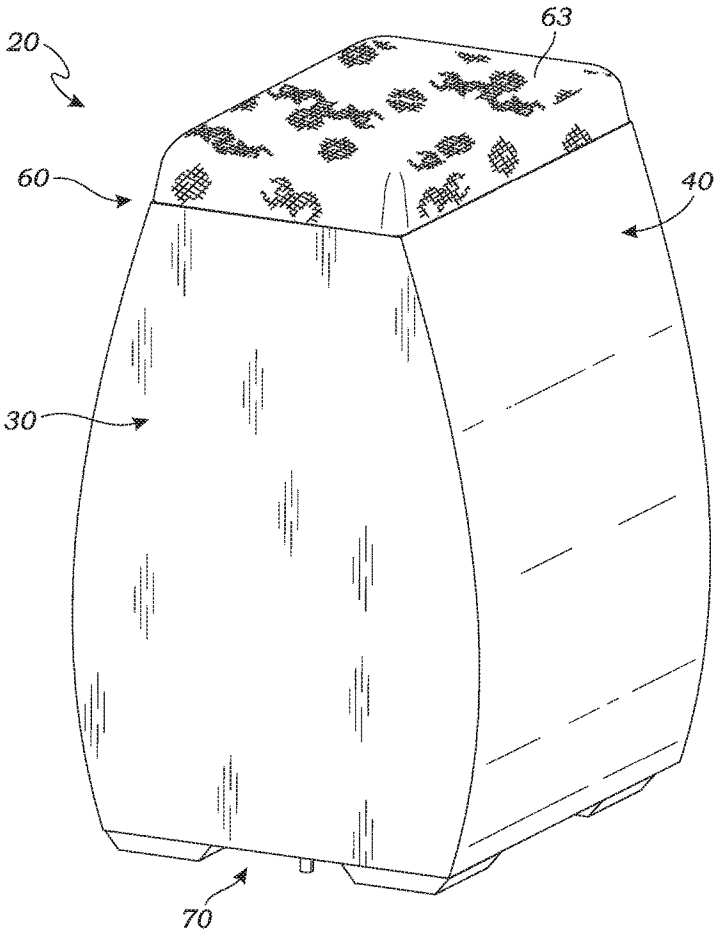
FIG. 4 is a front perspective view of an alternative exemplary drum apparatus, in accordance with at least one embodiment.

Referring now to FIGS. 4 and 5, there are shown a perspective view and a reduced scale front view of an alternative drum apparatus 20 according to aspects of the present invention. Once again the drum apparatus 20 generally comprises opposite, substantially upright side walls 40 and a substantially horizontal top wall 60 and an opposite, substantially horizontal bottom wall 70 interconnected with the side walls 40 and the front wall 30. Here, the side walls 40 are outwardly bowed in a plane substantially perpendicular to the front wall 30, whereby the front wall perimeter has outwardly curved left and right edges 33, 34. It will be appreciated that by forming the drum apparatus 20 with curved walls, relatively improved and certainly different sound quality or tones are produced as compared with more traditional rectangular cajónes or box drums. Moreover, in the exemplary embodiment, the bottom wall 70 is wider than the top wall 60, whereby the front wall perimeter defines a trapezoid having its parallel sides formed by the top and bottom walls 60, 70 and its non-parallel sides formed by the outwardly bowed side walls 40, or having a perimeter formed by the outwardly curved left and right edges 33, 34 and the substantially straight top and bottom edges 35, 36 of the front wall 30 of the drum 20. The curved sides 40 with narrow top 60 yield a great variety of sounds and tones, even in the relatively smaller upper region of the drum face 30. And with the maximum width of the drum 20 being near the mid-drum face 30, the reach for a "bass hit" is relatively shorter. To form such a curve-sided or contoured drum apparatus 20, in the exemplary embodiment the framework 80 (FIGS. 9 and 10) is made by gluing six (6) layers of approximately one eighth inch (⅛ in) thick and approximately four and one eighth inch (4-⅛ in.) wide wood and clamping the layered wood in a mold to retain the desired curved shape. After approximately twenty-four hours (24 hrs.) of cure time, the wood is removed from the clamp and placed in a miter box to cut the top and bottom angles, in the exemplary embodiment at approximately twenty-two to twenty-seven degrees (22-27°). This single curved piece is then cut on a table saw into four (4) lengthwise pieces approximately seven eighths inch (⅞ in.) wide to form each corner or vertical frame member 81 (FIGS. 9 and 10) of the drum's framework 80. Here, the side walls 40 are made of two (2) layers of eighth inch (⅛ in.) thick plywood glued and clamped in a mold and again left for an approximately twenty-four hour (24 hr.) cure time to form the desired shape or curvature as with the frame members 81. The top and bottom walls 60, 70 are here cut from three quarter inch (¾ in.) plywood with the lateral edges cut to approximately twenty-two to twenty-seven degrees (22-27°) to substantially match the angles of the sides 40, again including the frame members 81. Those skilled in the art will appreciate that a variety of other such curved cajón- or box-style drums are possible according to aspects of the present invention without departing from its spirit and scope, such that the particular curved drum apparatus 20 shown and described is to be understood as illustrative and non-limiting. As shown, a cushion or seat 63 may again be positioned on the top wall 60 for added comfort; those skilled in the art will further appreciate in that regard that the narrower top of the drum 20 makes it relatively easier or more comfortable to straddle while playing.

Figure 6:
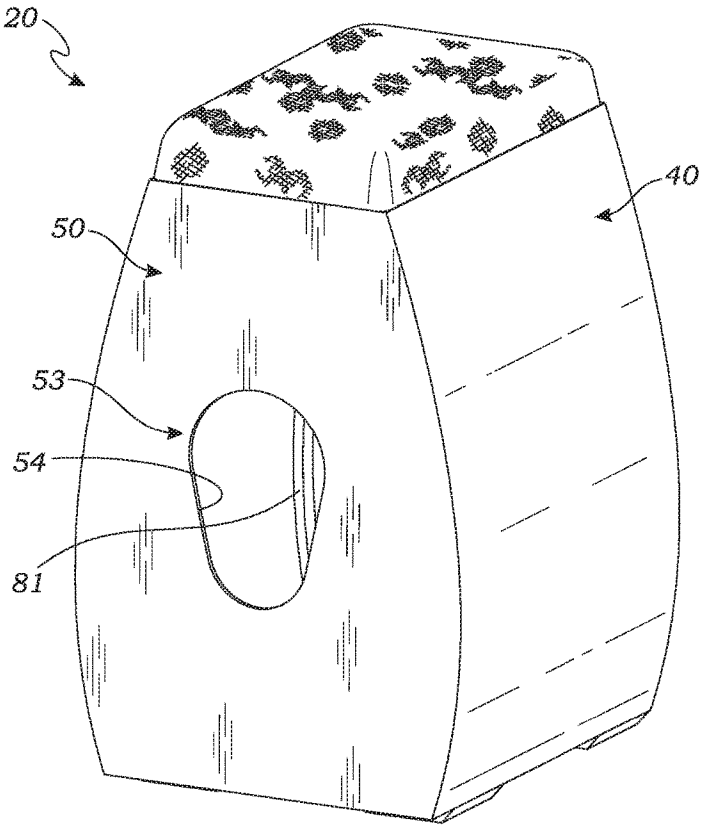
FIG. 6 is a rear perspective view thereof, in accordance with at least one embodiment.

Turning next to FIG. 6, there is shown a rear perspective view of the curve-sided drum apparatus 20 of FIGS. 4 and 5. Here, it can be seen that the rear wall 50 has substantially the same shape or profile as the front wall 30 (FIGS. 4 and 5) and is substantially opposite and parallel thereto. The rear wall 50 is further formed having a rear sound hole 53 substantially centered within the rear wall 50 and defining a rear sound hole opening 54 having a somewhat egg or inverted oval shape. Those skilled in the art will appreciate that the size, shape, and location of such a rear sound hole 53 can vary widely, such that that shown is illustrative and non-limiting. By way of example and not limitation, the rear sound hole opening 54 may be of a shape selected from a circle, an ellipse, an oval, an egg, a nephroid, a folium, a teardrop, a triangle, a trefoil, a circular segment, an arch, a lens, and a stadium. While such an alternative sound hole 53 is shown here in the context of the alternative curve-sided drum apparatus 20, it will be appreciated that any such sound hole may also be employed in other drum configurations, including but not limited to the straight-sided drum apparatus 20 of FIGS. 1-3. From this view in FIG. 6, one of the front frame members 81 is visible through the rear sound hole 53.

Figure 7:
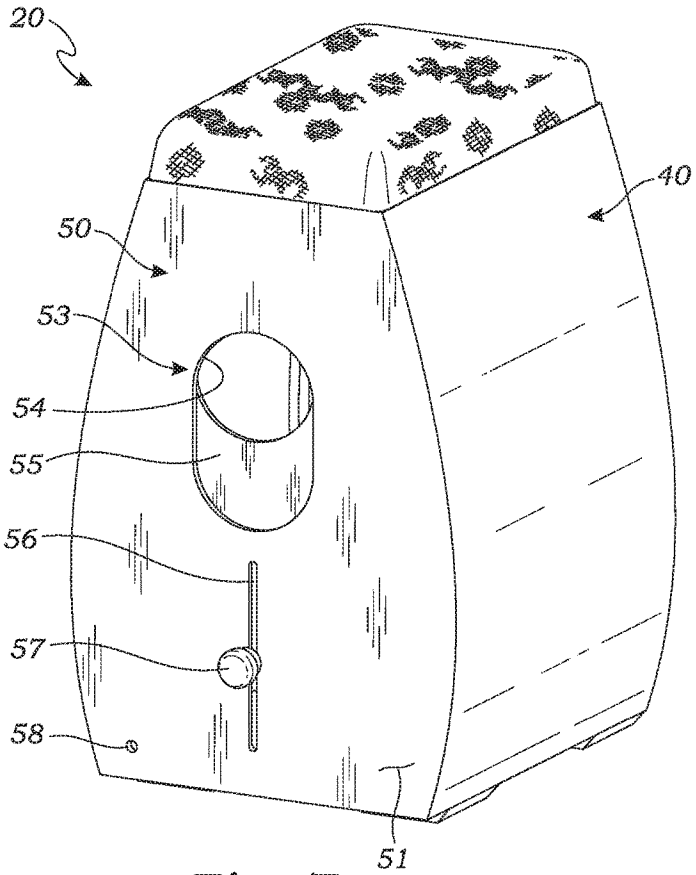
FIG. 7 is a rear perspective view of a further alternative exemplary drum apparatus, in accordance with at least one embodiment.

With reference to the rear perspective view of FIG. 7 showing a further alternative drum apparatus 20 according to aspects of the present invention, once again, a rear sound hole 53 is formed in the rear wall 50, here having a rear sound hole opening 54 that is substantially oval or stadium shaped. Further, a slidable sound hole cover 55 is positioned adjacent to the rear sound hole 53 for selectively adjusting the size of the rear sound hole opening 54, whereby the rear sound hole 53 may be left open or may be partially or fully closed. More particularly, in the exemplary embodiment, the sound hole cover 55 is positioned inside the drum apparatus 20 so as to slidably operate substantially parallel to the rear wall 50 against the inner surface 52 (FIGS. 9A and 9B), though it will be appreciated that the cover 55 may also be operably positioned adjacent to the outer surface 51 of the rear wall 50. In order to maintain the desired position and movement of the sound hole cover 55, a substantially vertically oriented sound hole cover slot 56 may be formed in the rear wall 50 beneath the rear sound hole 53 with a sound hole cover knob 57 threadably engaging the sound hole cover 55 through the slot 56. In use, the knob 57 may be loosened and it and hence the sound hole cover 55 itself slid up or down within the slot 56 until the cover 55 is in the desired position in terms of defining a particular sound hole opening 54, and then the knob 57 may be tightened to secure the cover 55 in place. To further facilitate the linear movement of the cover 55 while maintaining the close proximity and position of the cover 55 relative to the rear wall inner surface 52, the cover 55 may be configured to ride in opposite slots (not shown) or the like. All such components may be made of wood or other such materials now known or later developed; in one exemplary embodiment, the cover 55 may be made of Masonite® or hardboard. As with all other aspects of the drum apparatus 20, any other such physical or mechanical arrangement of the sound hole cover 55 for selectively adjusting the effective size and/or shape of the rear sound hole 53 may be employed according to aspects of the present invention without departing from its spirit and scope. Those skilled in the art will appreciate that, like other features such as tuning the drum head, the selective adjustment of the rear sound hole 53 is preferably to be done before playing, rather than during playing like the convenient "snare on/off" feature described above. Once more, any such sound hole 53 and related adjustment features can be incorporated in other drums beyond the particular curve-sided drum 20 shown in FIG. 7. As one further optional feature shown, there may be formed in the rear wall 50 a rear cord hole 58 for selectively passing an end of a microphone cord or the like into the drum apparatus 20 in the event that the drum is to be "mic'd" or have a microphone positioned internally. It will be appreciated that the microphone itself can be inserted and removed through the rear sound hole 53, but it may be desirable to pass the microphone cord through its own hole 58 rather than through the sound hole 53.

Figure 8:
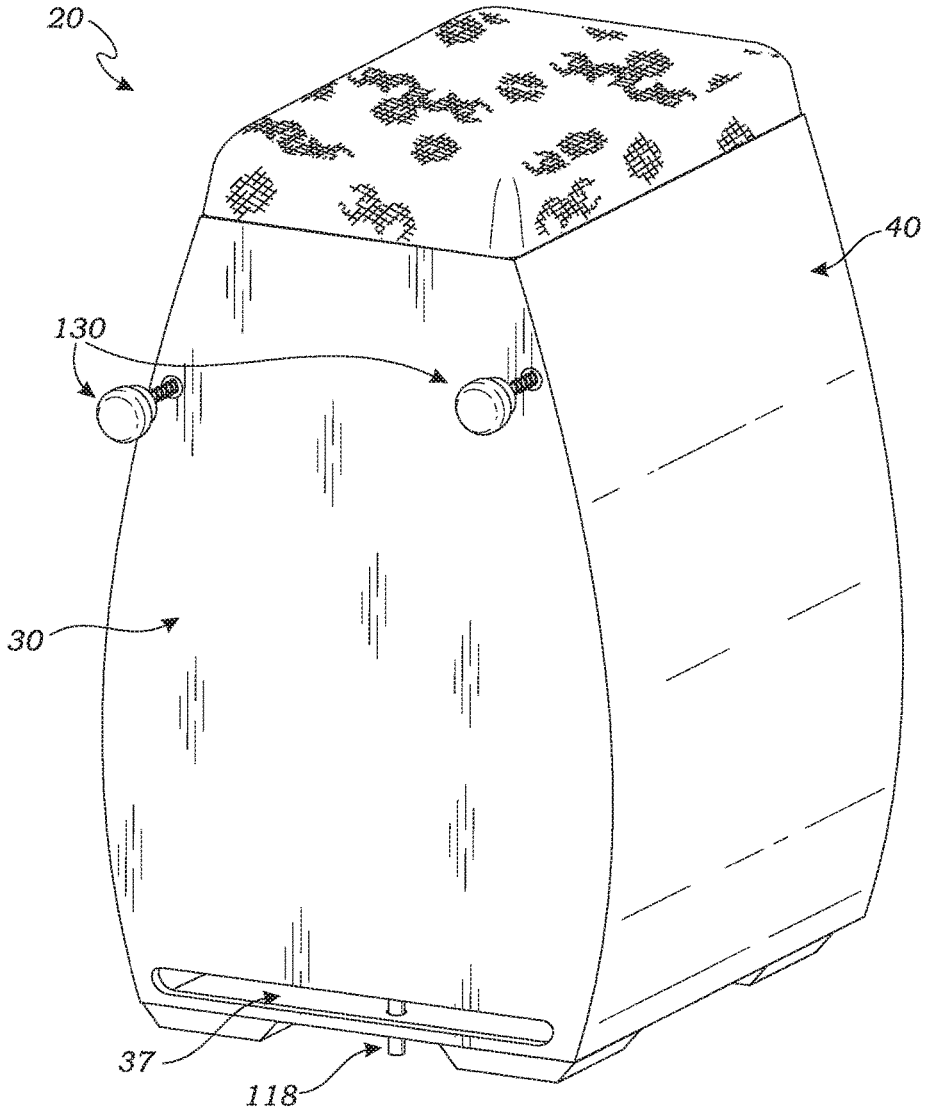
FIG. 8 is a front perspective view of a still further alternative exemplary drum apparatus, in accordance with at least one embodiment.

Turning briefly to the front perspective view of FIG. 8, there is shown a still further alternative curve-sided drum apparatus 20 according to aspects of the present invention, here having an optional front sound hole 37 formed at the base of the front wall 30, which may be particularly suited to relatively taller drums. As shown, the front sound hole 37 may be substantially rectangular or an elongated oval or may take a number of other forms as desired, though it will be appreciated that preferably the front sound hole 37 would be positioned in the lower half of the front wall 30 so as to not adversely affect its primary function as the drum head. Those skilled in the art will appreciate that the front sound hole 37 gives the percussionist the option of directing at least some of the sound forward. As seen, the actuator leg 118 of the rocker assembly 100 (FIGS. 9A, 9B and 10) is visible through the front sound hole 37. As also shown in FIG. 8, the drum apparatus 20 may also be configured with one or more second percussion accessories 130, more about which is said below.

Figure 9A:
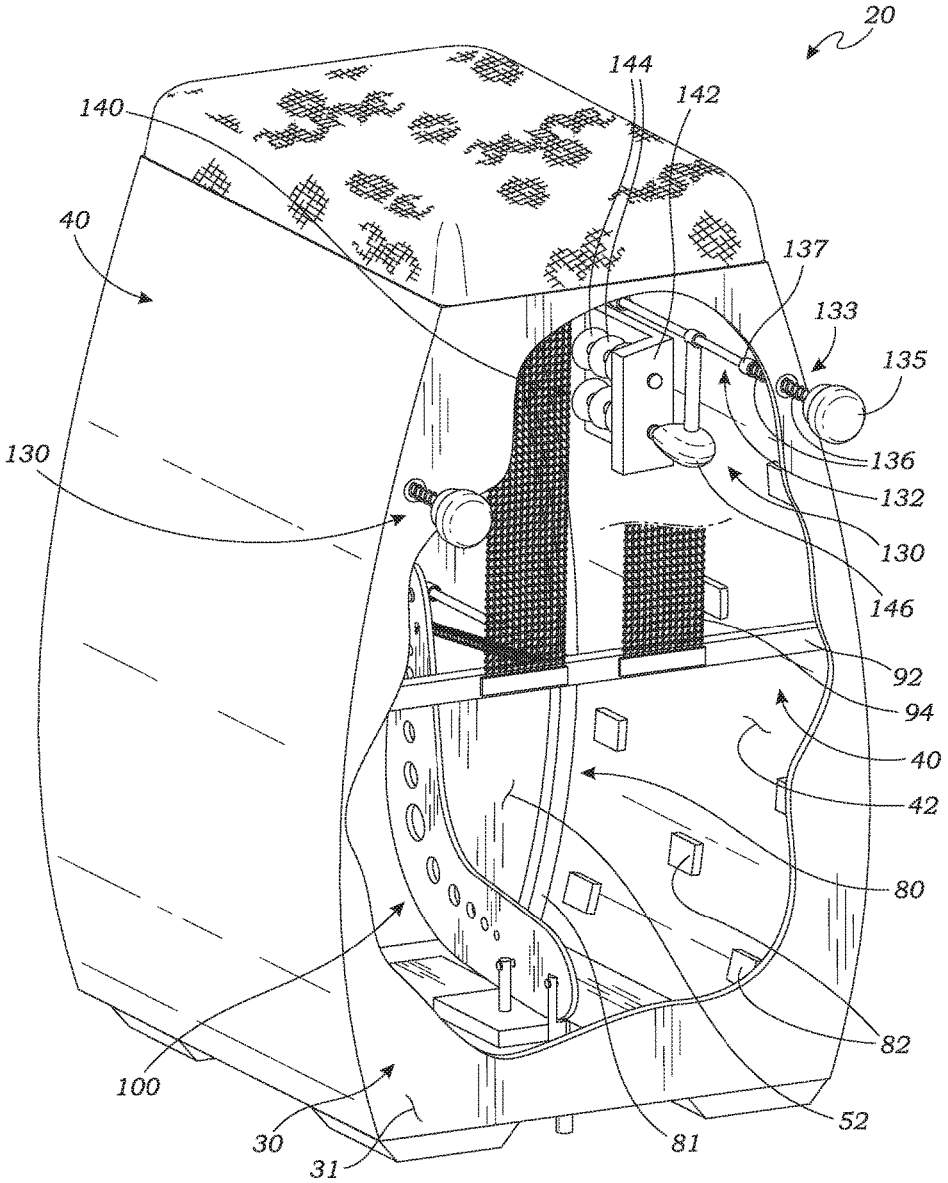
FIG. 9A is a first partial front perspective view of a still further alternative exemplary drum apparatus, in accordance with at least one embodiment.
Figure 9B:
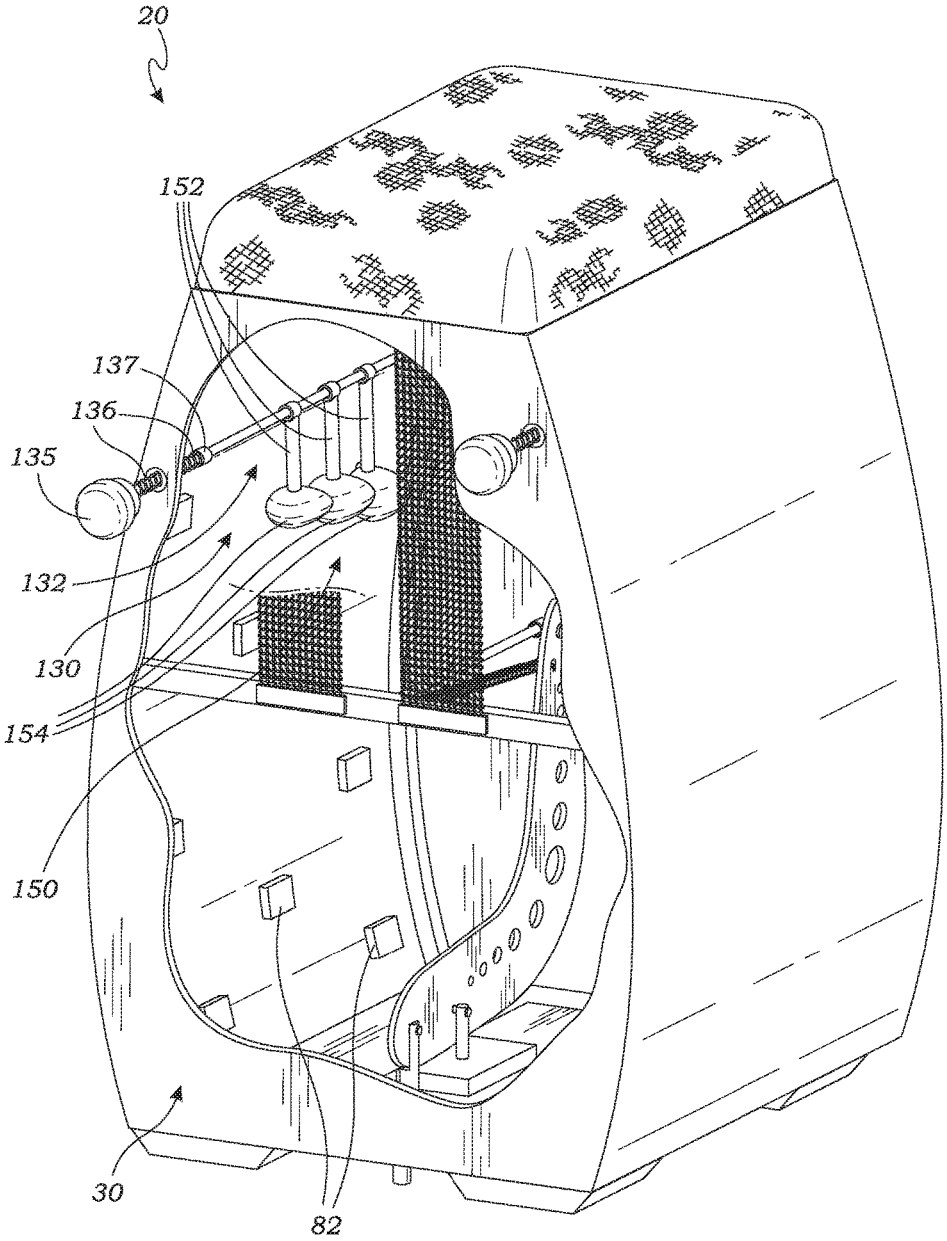
FIG. 9B is a second partial front perspective view thereof, in accordance with at least one embodiment.

Referring next to FIGS. 9A and 9B, there are shown front perspective views from two different vantage points of a still further alternative drum apparatus 20 according to aspects of the present invention here with the front wall 30 partially cut away or removed along with a portion of one of the snare wires 94 to reveal internal features of the drum 20. Particularly, with reference first to FIG. 9A, the drum apparatus 20 comprises a second percussion accessory 130 operatively mounted in conjunction with an actuator rod 132 slidably installed so as to extend from the front wall 30 to the opposite rear wall 50 (FIG. 10) of the drum apparatus 20 and to selectively play a percussion instrument or make a percussion sound. While the rod 132 is shown and described as extending essentially from front to back of the drum 20, it need not and may instead be operable in or across only a portion of the drum 20. Similarly, while the rod is shown as being operably installed at the marginal edge of the front wall 30, other locations are also possible. In the exemplary embodiment, the actuator rod 132 is made of one-quarter inch (¼ in) aluminum rod threaded on one end to receive an actuator knob 135. For reduced friction, nylon bushings or the like may be installed within the holes in the walls or framework of the drum as appropriate. The actuator rod 132 has at least one actuator spring 136 configured to bias the actuator rod 132 toward the front wall 30 where the actuator knob 135 is positioned on the front end 133 of the actuator rod 132 offset from the front wall outer surface 31. With the exemplary actuator rod 132, one actuator spring 136 is configured in compression between the actuator knob 135 and the front wall outer surface 31, which spring 136 it will be appreciated serves to bias the actuator rod 132 toward the front of the drum 20, such that if the rod 132 is shifted rearwardly as by pushing on or striking the knob 135, once any such force is released the compression spring 136 between the front wall 30 and the knob 135 will shift the rod 132 forwardly once again. Further, as also shown in the exemplary embodiment, a second actuator spring 136 may be positioned about the rod 132 also in compression but here internally between the front wall inner surface 32 (FIG. 10) and an actuator keeper 137 installed on the actuator rod 132 spaced from the front wall 30, this second spring 136 serving to offset the first and somewhat "cushion" the rod's forward return, the two somewhat "equal and opposite" springs 136 effectively balancing the actuation rod 132 in its neutral or "at rest" position in readiness for actuation, whereby selectively striking the actuator knob 135 temporarily shifts the actuator rod 132 rearwardly against the biasing effect of the outer actuator spring 136 so as to play the second percussion accessory 130. Those skilled in the art will appreciate that, though not shown, a third actuator spring 136 could be positioned near the opposite rear end 134 (FIG. 10) of the actuator rod 132 so as to, in compression, also bias the rod 132 forwardly. Or, such a rear internal actuator spring 136 could be used instead of the spring 136 shown between the actuator knob 135 and the drum head 30. In any case, with continued reference to FIG. 9A, the second percussion accessory 130 is here shown as comprising a jingles assembly 140 having a jingles mount 142 installed internally within the drum 20, such as on the side wall inner surface 42, with jingles 144 operably installed on the jingles mount 142. A jingles mallet 146 is installed on the actuator rod 132 offset forwardly from the jingles mount 142, whereby the jingles mallet 146 strikes the jingles mount 142 so as to play the jingles 144 when the actuator rod 132, and the actuator knob 135, specifically, is selectively struck to temporarily shift the actuator rod 132 rearwardly. Those skilled in the art will appreciate that a variety of other such percussion jingles and the like and arrangements thereof as optionally forming or defining the second percussion accessory 130 are possible without departing from the spirit and scope of the invention. As such, the particular configuration and location of the jingles assembly 140 is to be understood as illustrative and non-limiting. Referring now to FIG. 9B so as to effectively look into the front of the exemplary drum apparatus 20 from an opposite angle, there is shown an alternative second percussion accessory 130 positioned on the opposite side or marginal edge similarly comprising an actuator rod 132 having an actuator knob 135 and actuator springs 136 on the rod 132 on opposite sides of the front wall 30. Here, one or more shaker assemblies 150 are installed internally on the actuator rod 132 so as to provide an alternative percussion sound when the actuator rod 132 is activated as by striking the actuator knob 135. In the exemplary embodiment shown, there are three shaker assemblies 150 spaced along the actuator rod 132 within the drum 20, each comprising a shaker mount 152 here consisting of a shaft extending downwardly from the rod 132 and each terminating in a shaker 154—as shown, each shaker 154 may be of a different size and so make a different sound or pitch. Those skilled in the art will appreciate that any number, style, size, and arrangement of such shaker assemblies 150 as the second percussion accessory 130 are possible without departing from the spirit and scope of the invention, such that the particular configuration and location of the shaker assemblies 150 is to be understood as illustrative and non-limiting.

Figure 10:
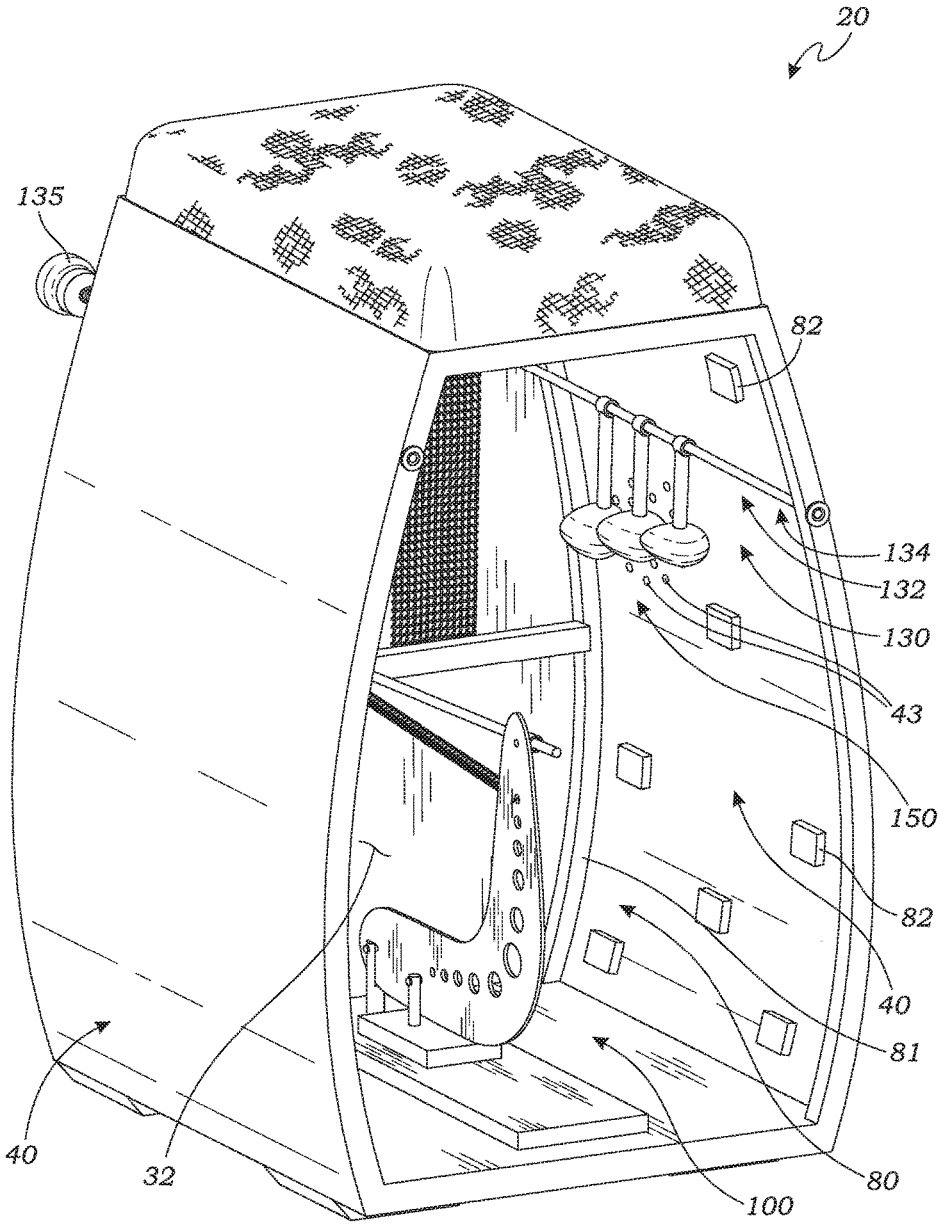
FIG. 10 is a partial rear perspective view thereof, in accordance with at least one embodiment.

Referring to FIG. 10, a rear perspective view of the same drum apparatus 20 as shown from the front in FIGS. 9A and 9B, here with the rear wall 50 removed entirely for clarity, there is shown from this vantage point the alternative second percussion accessory 130 of FIG. 9B including the shaker assemblies 150 on the actuation rod 132. As shown, an optional pattern of side sound holes 43 may be formed in the side wall 40 of the drum 20 so as to enhance the sound output of the second percussion accessory 130, here shakers, from the drum apparatus 20. It will be appreciated that a variety of such side sound holes 43 in terms of number, size, shape, and location, is possible in the present invention. As also shown in FIG. 10 as well as FIGS. 9A and 9B, any such drum apparatus 20 may further optionally include sound dampening devices 82 therein. In the exemplary embodiment, such sound dampening devices 82 comprise open-cell foam blocks placed throughout the interior of the drum 20, as by being affixed to one or more of the inner surfaces 32, 42, 52, 62, 72 thereof. The illustrated foam blocks are nominally approximately one to two inch (1-2 in.) squares approximately one-half inch (½ in.) thick, though it will be appreciated that such devices 82 may take a variety of other forms, sizes, shapes, and materials without departing from the spirit and scope of the invention. By way of example and not limitation, the blocks 82 may have all edges or corners chamfered or angled to provide more surfaces for the sound to reflect off of or be absorbed by, in any event the sound dampening devices 82, as the name implies, serving to dampen the sound within the drum 20 and so prevent or reduce unwanted echo effects.

Figure 11A:
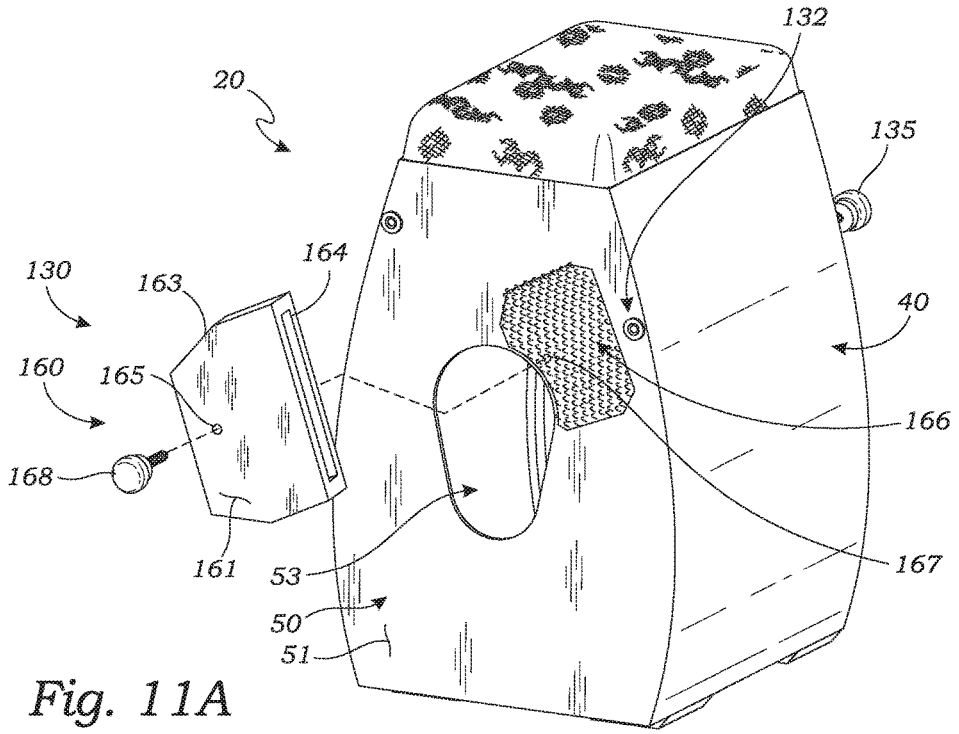
FIG. 11A is a rear perspective view of a still further alternative exemplary drum apparatus, in accordance with at least one embodiment.
Figure 11B:
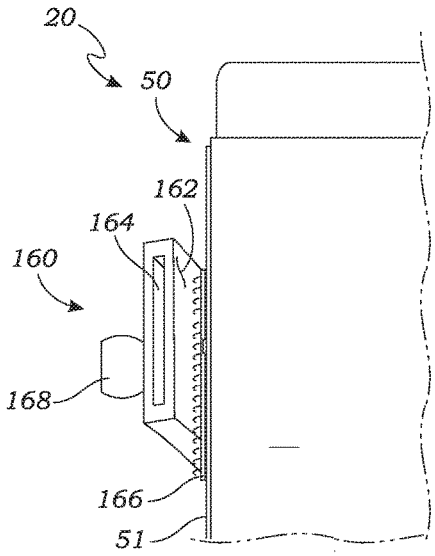
FIG. 11B is a partial side schematic view thereof in a first operational mode, in accordance with at least one embodiment.
Figure 11C:
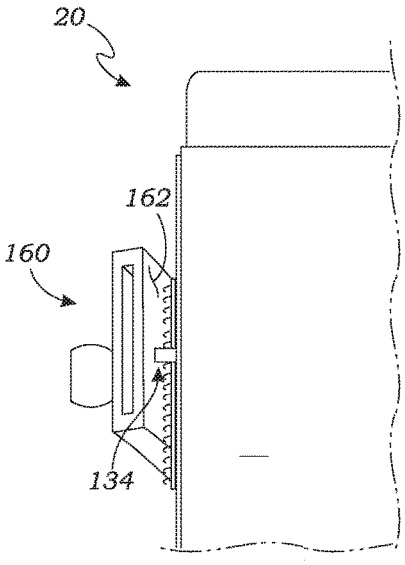

Turning next to FIGS. 11A-11C, there is shown yet another alternative drum apparatus 20 with a second percussion accessory 130, here configured as a block 160 such as made of wood, metal, or plastic operably installed in conjunction with the actuator rod 132 (FIGS. 9A, 9B, and 10). As shown, the block 160 is substantially flat and rectangular in overall shape, having an outer surface 161 and a substantially opposite inner surface 162 that in use is oriented toward the rear wall outer surface 51. The block 160 may have a block core 164 such that the block 160 is at least partially hollowed out for further sound effects. The block 160 is further formed with an incline 163 along one side of the inner surface 162 so that when the block 160 is mounted adjacent to the rear wall 50 of the drum 20, it is not parallel thereto or fully in contact therewith, instead the incline 163 being substantially flush with the rear wall outer surface 51 and the balance of the block inner surface 162, or the region opposite the incline 163, being spaced from the rear wall outer surface 51. In the exemplary embodiment, the incline 163 is at an angle of approximately seven degrees (7°) relative to the substantially planar block inner surface 162 and hence the rear wall outer surface 51. For purposes of locating and mounting the block 160, a block mount 166 is installed on the rear wall outer surface 51 essentially where the block 160 is to be positioned, here substantially adjacent the rear sound hole 53, or between the rear sound hole 53 and the side 40 of the drum in the direction of the actuator rod 132, the block mount 166 being formed as hook and loop fastener or Velcro® material and a similar mating swatch being formed on the block inner surface 162 to again facilitate locating and securing the block 160 in place on the rear wall 50 of the drum 20. To further and really fully secure the block 160 in position, a block mount bolt 168 may be passed through a block hole 165 formed in the block 160 and then threadably engaged in a block mount hole 167 formed in the rear wall 50 of the drum as part of the block mount 166. It will be appreciated that such Velcro® engagement further provides a bit of mounting "play" so as to effectively enable tuning of the block 160 based on the degree of tightening of the block mount bolt 168. Once more, those skilled in the art will appreciate that a wide variety of block configurations and related mounting arrangements are possible according to aspects of the present invention without departing from its spirit and scope. Notably, with particular reference now to the partial side schematic views of FIGS. 11B and 11C, there are shown the drum apparatus 20 with the second percussion accessory 130 configured as the block 160 mounted as above-described on the rear wall 50 of the drum 20 in two operational modes: basically "at rest" (FIG. 11B); and as being struck or played (FIG. 11C). Those skilled in the art will appreciate that by essentially positioning the block 160 such that its inner surface 162 is offset and spaced from the rear wall outer surface 51 and particularly the actuator rod 132 (FIG. 11A), when the actuator rod knob 135 is selectively struck and the actuator rod 132 is temporarily or momentarily shifted rearwardly as shown in FIG. 11C, the rear end 134 of the actuation rod 132 extends beyond the rear wall outer surface 51 and so strikes the block inner surface 162, thereby producing the desired percussion sound from the block 160. Again, the block 160 may be formed of wood, metal, plastic, or any other such material now known or later developed as desired for producing a particular sound. Such blocks 160 can be easily exchanged as desired, though again this would be an adjustment to the drum apparatus 20 to be made other than while playing. Though one block 160 is shown adjacent one actuator rod 132, it will be appreciated that multiple blocks 160 may be incorporated, whether in conjunction with the same or multiple such actuator rods 132 or even standing alone, as will be further appreciated with reference to FIGS. 12 and 13 described further below relating to an externally mounted cymbal 172. Those skilled in the art will appreciate that an actuator rod 132 may be configured solely for striking or selectively playing such a block 160 or may be configured as described above in connection with FIGS. 9A, 9B and 10 so as to also incorporate other second percussion accessories 130 like jingles or shakers, in which case the block 160 would be played substantially simultaneously with the jingle, shaker or other percussion accessory operably installed on or in conjunction with the same actuator rod 132 configured to strike the block 160. Again, a variety of such arrangements is possible according to aspects of the present invention without departing from its spirit and scope. By way of example and not limitation, instead of or in addition to a wood or other such block 160, a cow bell or tambourine may be installed on the rear wall 50 of the drum 20 so as to be selectively struck and played by an actuator rod 132, or again, perhaps in some other location so as to be struck by means other than an actuator rod 132. Relatedly, in a further alternative embodiment, a third actuator rod 132 may be operably installed in the drum 20, for striking a cow bell, tambourine or other instrument, or otherwise, such that the two actuator rods 132 shown is to be understood as illustrative and non-limiting. Of course, there may be only one actuator rod 132, two as shown, or three or more without departing from the spirit and scope of the present invention.

Figure 12:
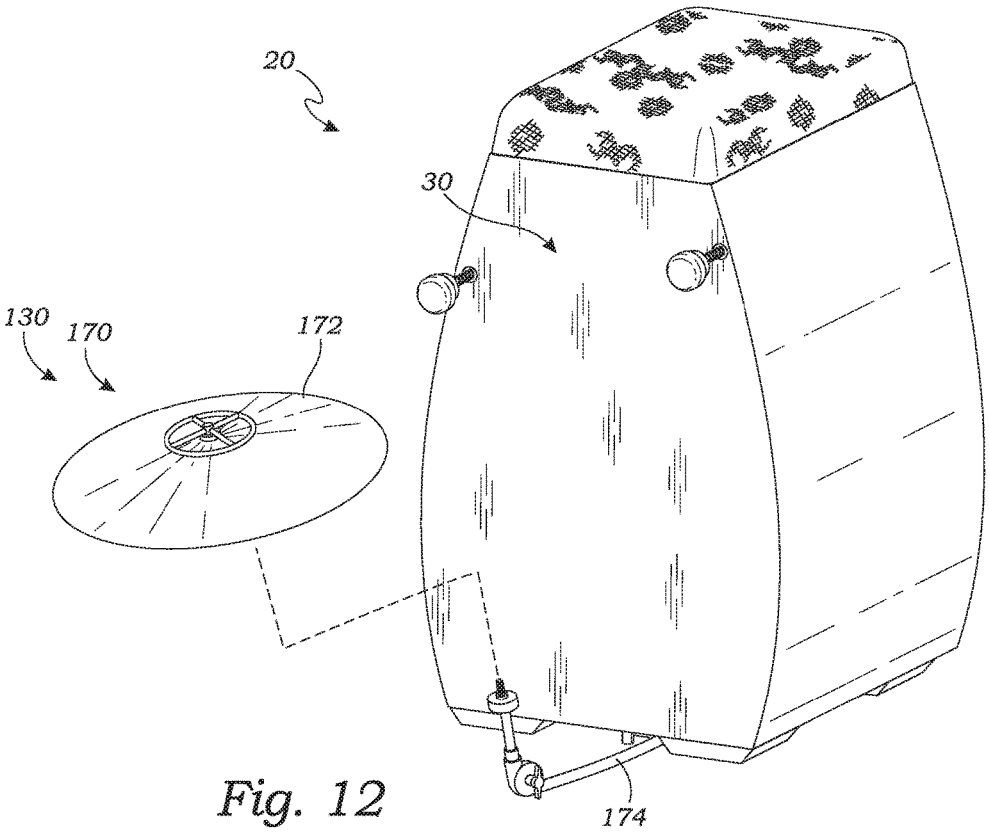
FIG. 12 is a partially exploded front perspective view of a still further alternative exemplary drum apparatus, in accordance with at least one embodiment.
Figure 13:
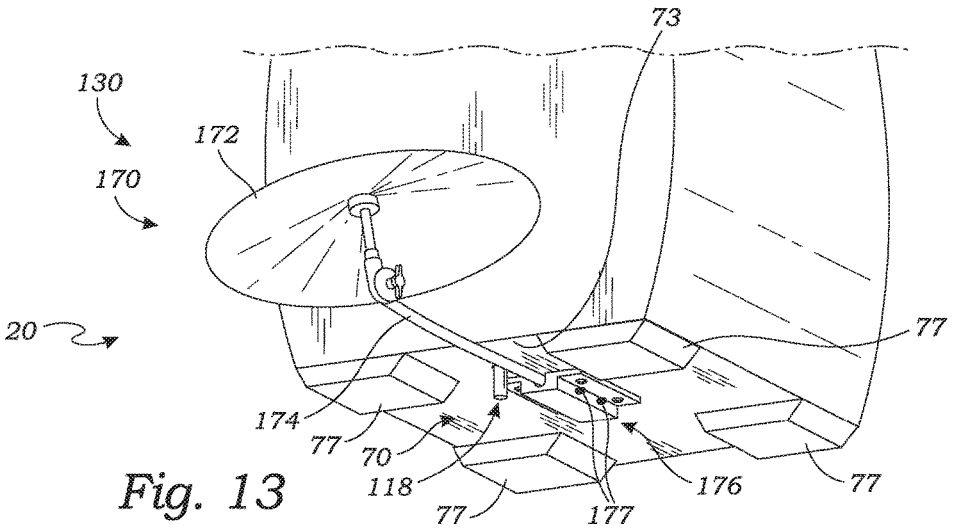
FIG. 13 is a partial bottom perspective view thereof, in accordance with at least one embodiment.

Finally, referring to FIGS. 12 and 13, there is shown yet another alternative drum apparatus 20 according to aspects of the present invention with a further second percussion accessory 130, here configured as a cymbal assembly 170 comprising a cymbal 172 mounted on a cymbal arm 174 slidably received within a cymbal mount 176 externally installed on the outer surface 71 of the bottom wall 70 of the drum apparatus 20 so as to extend forwardly of the bottom wall front edge 73 and offset from the front wall 30 thereof. As best seen in the partial bottom perspective view of FIG. 13, the cymbal mount 176 is formed as a relatively low profile bracket installed on the downwardly-facing outer surface 71 of the bottom wall 70 substantially between the feet 77 having a channel within which the cymbal arm 174 is slidably received and one or more set screws 177 to secure the cymbal arm 174 in the desired position within the cymbal mount 176. Particularly, the cymbal mount 176 is positioned offset from the center of the bottom wall 70 so that the cymbal arm 174 may extend horizontally and outwardly from the cymbal mount 176 between and without any interference of or with the nearest foot 77 or the downwardly-extending actuator leg 118 of the rocker assembly 100 (FIGS. 1-3 and 9A). Those skilled in the art will appreciate that with the cymbal 172 so positioned, it may be selectively played while playing the drum 20 using a hand or foot, stick or mallet, or any other appropriate implement. It will be further appreciated that a variety of other percussion instruments may be similarly installed and played on the front or forward side of the drum 20 employing such a mount and mounting arm, such that the invention is not limited to the cymbal 172 or cymbal assembly 170 shown and described as yet another alternative exemplary embodiment of a second percussion accessory according to aspects of the present invention.

It will be appreciated by those skilled in the art that the various features of the drum apparatus 20 according to aspects of the present invention as shown and described herein may be combined in a variety of ways without departing from the spirit and scope of the invention. By way of example and not limitation, a straight-sided drum or a curve-sided drum may include or not include the snare feature, one or more other percussion accessory features, or any of the front, side or rear sound hole features.

Aspects of the present specification may also be described as follows:

1. A drum apparatus comprising: at least a front wall having an inner surface and an opposite outer surface, the front wall having a front wall perimeter and defining a drum head that is played by selectively striking the front wall outer surface; a snare bar rotatably installed substantially parallel to and offset from the front wall inner surface, the snare bar having at least one snare wire extending substantially vertically therefrom so as to be adjacent to and selectively in contact with the front wall inner surface, the snare bar and at least one snare wire together defining a first percussion accessory of the drum apparatus; and a rocker assembly for selectively operating the first percussion accessory, the rocker assembly comprising a lever mechanically coupled to the snare bar at a first end of the lever and further comprising an actuator leg pivotally coupled to and extending downwardly from an opposite second end of the lever so as to be directed toward a ground surface on which the drum apparatus may be positioned, the lever being pivotally installed within the drum apparatus on a support post coupled to the lever intermediate the first and second ends thereof; whereby the drum apparatus is shifted between first and second operational modes by selectively positioning the drum apparatus either substantially flat on the ground surface with the actuator leg in contact with the ground surface and so shifting the actuator leg upward or with the drum apparatus tipped back so as to raise the front wall away from the ground surface and shift the actuator leg downward, the movement of the actuator leg as acting on the second end of the lever thereby causing the lever to pivot about the support post so as to shift the first end of the lever up or down and toward or away from the front wall and thereby rotate the snare bar to shift the at least one snare wire away from and substantially out of contact with or toward and substantially into contact with the front wall inner surface, such that the first percussion accessory is selectively played when the front wall outer surface of the drum apparatus is struck based on the drum apparatus being in either the first or the second operational mode.

2. The drum apparatus of embodiment 1 wherein the rocker assembly further comprises a rocker spring connected to the lever and configured to bias the first end thereof toward the front wall and thus to bias the rocker assembly into the second operational mode with the actuator leg shifted downward and the snare bar rotated such that the at least one snare wire is substantially in contact with the front wall inner surface, whereby maintaining the rocker assembly in the first operational mode with the at least one snare wire shifted away from and substantially out of contact with the front wall inner surface is achieved by shifting the actuator leg upward and the first end of the lever away from the front wall against the biasing effect of the rocker spring as by positioning the drum apparatus substantially flat on the ground surface with the actuator leg in contact therewith.

3. The drum apparatus of embodiment 1 or embodiment 2 wherein the rocker assembly further comprises a snare rod having a front end fixed to the snare bar and an opposite rear end engaged with the first end of the lever.

4. The drum apparatus of embodiment 3 wherein: a slide loop is installed on the first end of the lever; and the rear end of the snare rod is slidably received within the slide loop.

5. The drum apparatus of embodiment 4 further comprising a mechanical stop positioned on the snare rod so as to selectively contact the slide loop and thereby limit the degree of slidable travel of the snare rod within the slide loop and thus the degree of rotation of the snare bar and the degree of pressure exerted by the at least one snare wire against the front wall inner surface.

6. The drum apparatus of embodiment 1 wherein the lever has a substantially boomerang shape defining a substantially vertical first leg and a substantially horizontal second leg.

7. The drum apparatus of embodiment 6 wherein the support post is installed on a bottom wall of the drum apparatus so as to extend upwardly therefrom, the support post being coupled to the lever second leg substantially offset from the actuator leg.

8. The drum apparatus of embodiment 7 wherein the actuator leg is configured to slidably operate within a leg hole formed in the bottom wall, the actuator leg being of sufficient length to selectively extend substantially perpendicularly from the bottom wall.

9. The drum apparatus of embodiment 1 further comprising opposite, substantially upright side walls and a substantially horizontal top wall and an opposite, substantially horizontal bottom wall interconnected with the side walls and the front wall, the side walls being outwardly bowed in a plane substantially perpendicular to the front wall, whereby the front wall perimeter has outwardly curved left and right edges.

10. The drum apparatus of embodiment 9, wherein the bottom wall is wider than the top wall, whereby the front wall perimeter defines a trapezoid having its parallel sides formed by the top and bottom walls and its non-parallel sides formed by the outwardly bowed side walls.

11. The drum apparatus of embodiment 1 further comprising a rear wall substantially opposite and parallel to the front wall and having a rear wall perimeter substantially conforming to the front wall perimeter, the rear wall having a rear sound hole formed therein defining a rear sound hole opening having a shape selected from a circle, an ellipse, an oval, an egg, a nephroid, a folium, a teardrop, a triangle, a trefoil, a circular segment, an arch, a lens, and a stadium.

12. The drum apparatus of embodiment 11 further comprising a slidable sound hole cover adjacent to the rear sound hole for selectively adjusting the size of the rear sound hole opening, whereby the rear sound hole may be left open or may be partially or fully closed.

13. The drum apparatus of embodiment 1 further comprising a front sound hole formed at the base of the front wall.

14. The drum apparatus of embodiment 1 further comprising a second percussion accessory operatively mounted in conjunction with an actuator rod slidably installed so as to extend from the front wall to an opposite rear wall of the drum apparatus, the actuator rod having at least one actuator spring configured to bias the actuator rod toward the front wall and further configured with an actuator knob positioned on the actuator rod offset from the front wall outer surface, whereby selectively striking the actuator knob temporarily shifts the actuator rod rearwardly against the biasing effect of the actuator spring so as to play the second percussion accessory.

15. The drum apparatus of embodiment 14 wherein the second percussion accessory is selected from the group consisting of a shaker mounted internally on the actuator rod, jingles mounted internally on a side wall of the drum apparatus so as to be selectively struck by a mallet mounted internally on the actuator rod offset from the jingles, and a block mounted externally on the rear wall of the drum apparatus so as to be selectively struck by a rear end of the actuator rod opposite the actuator knob.

16. The drum apparatus of embodiment 14 or embodiment 15 further comprising one or more side sound holes formed in the side wall of the drum apparatus substantially offset from the second percussion accessory.

17. The drum apparatus of embodiment 1 further comprising a second percussion accessory configured as a cymbal mounted on a cymbal arm slidably received within a cymbal mount externally installed on an outer surface of a bottom wall of the drum apparatus so as to extend forwardly offset from the front wall thereof.

18. The drum apparatus of embodiment 1 further comprising a plurality of sound dampening devices installed internally therein.

In closing, regarding the exemplary embodiments of the present invention as shown and described herein, it will be appreciated that a drum apparatus is disclosed and configured for enabling a wider variety of sounds and convenience in playing. Because the principles of the invention may be practiced in a number of configurations beyond those shown and described, it is to be understood that the invention is not in any way limited by the exemplary embodiments, but is able to take numerous forms without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

Specific embodiments disclosed herein may be further limited in the claims using consisting of or consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of the present invention so claimed are inherently or expressly described and enabled herein.

All patents, patent publications, and other publications referenced and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents is based on the information available to the applicants and does not constitute any admission as to the correctness of the dates or contents of these documents.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A drum apparatus comprising a percussion accessory operatively mounted in conjunction with an actuator rod slidably installed so as to extend from a wall of the drum apparatus, the actuator rod having at least one actuator spring configured to bias the actuator rod outwardly and further configured with an actuator knob positioned on the actuator rod offset from the wall, whereby selectively striking the actuator knob temporarily shifts the actuator rod inwardly against the biasing effect of the actuator spring so as to play the percussion accessory.

2. The drum apparatus of claim 1 wherein a first actuator spring is positioned on the actuator rod between the actuator knob and the wall so as to bias the actuator rod toward the wall.

3. The drum apparatus of claim 1 wherein a second actuator spring is positioned on the actuator rod between the wall and an actuator keeper installed on the actuator rod spaced from the wall so as to bias the actuator rod away from the wall and thus serving to offset the first actuator spring, whereby return of the actuator rod under the influence of the first actuator spring is cushioned under the influence of the second actuator spring, further whereby the first and second actuator springs effectively balance the actuation rod in a neutral position in readiness for actuation, wherein selectively striking the actuator knob temporarily shifts the actuator rod inwardly against the biasing effect of the first actuator spring so as to play the percussion accessory.

4. The drum apparatus of claim 1 wherein the actuator rod is slidably installed through both a front wall of the drum apparatus and a front frame member of the drum apparatus on which the front wall is installed.

5. The drum apparatus of claim 4 wherein the actuator rod is further slidably installed through both a rear wall of the drum apparatus and a rear frame member on which the rear wall is installed.

6. The drum apparatus of claim 1 wherein the percussion accessory comprises a shaker assembly mounted internally on the actuator rod.

7. The drum apparatus of claim 6 wherein the shaker assembly comprises a shaker mount extending downwardly from the actuator rod and terminating in a shaker.

8. The drum apparatus of claim 1 wherein the percussion accessory comprises a jingles assembly mounted internally so as to be selectively struck by a mallet mounted internally on the actuator rod offset from the jingles assembly.

9. The drum apparatus of claim 8 wherein the jingles assembly comprises a jingles mount installed on a side wall of the drum apparatus and jingles operably installed on the jingles mount, and further wherein the jingles mallet is installed on the actuator rod offset forwardly from the jingles mount so as to strike the jingles mount so as to play the jingles when the actuator knob is selectively struck to temporarily shift the actuator rod rearwardly.

10. The drum apparatus of claim 1 wherein the percussion accessory comprises a block mounted externally on a rear wall of the drum apparatus so as to be selectively struck by a rear end of the actuator rod opposite the actuator knob.

11. The drum apparatus of claim 10 wherein the block is spaced from the rear wall adjacent to the rear end of the actuator rod.

12. The drum apparatus of claim 11 wherein the block is removably mounted on the rear wall.

13. The drum apparatus of claim 1 further comprising one or more side sound holes formed in a side wall of the drum apparatus substantially offset from the percussion accessory.

14. The drum apparatus of claim 1 further comprising a front sound hole formed in a front wall of the drum apparatus.

15. The drum apparatus of claim 1 further comprising a plurality of sound dampening devices installed internally within the drum apparatus.

16. The drum apparatus of claim 1 wherein a rear wall of the drum apparatus comprises a rear sound hole formed therein defining a rear sound hole opening.

17. The drum apparatus of claim 16 wherein the rear sound hole opening has a shape selected from a circle, an ellipse, an oval, an egg, a nephroid, a folium, a teardrop, a triangle, a trefoil, a circular segment, an arch, a lens, and a stadium.

18. The drum apparatus of claim 16 further comprising a slidable sound hole cover adjacent to the rear sound hole for selectively adjusting the size of the rear sound hole opening, whereby the rear sound hole may be left open or may be partially or fully closed.

19. The drum apparatus of claim 18 wherein the sound hole cover is positioned inside the drum apparatus so as to slidably operate substantially parallel to the rear wall against a rear wall inner surface thereof.

20. The drum apparatus of claim 19 wherein a substantially vertically oriented sound hole cover slot is formed in the rear wall beneath the rear sound hole with a sound hole cover knob threadably engaging the sound hole cover through the sound hole cover slot, whereby in use the sound hole cover knob may be loosened and slid up or down within the sound hole cover slot until the sound hole cover is in a desired position to define a particular sound hole opening, and then the sound hole cover knob may be tightened to selectively secure the sound hole cover in place.

21. A drum apparatus comprising:

at least a front wall having an inner surface and an opposite outer surface, the front wall defining a drum head that is played by selectively striking the front wall outer surface; and a percussion accessory externally installed on an outer surface of a bottom wall of the drum apparatus so as to extend forwardly offset from the front wall.

22. The drum apparatus of claim 21 wherein the percussion accessory is configured as a cymbal mounted on a cymbal arm slidably received within a cymbal mount externally installed on the outer surface of the bottom wall of the drum apparatus.

23. The drum apparatus of claim 21 wherein the percussion accessory is at least one of a cymbal, a tambourine, a block, and a bell.

24. A drum apparatus comprising:

at least a front wall having an inner surface and an opposite outer surface, the front wall defining a drum head that is played by selectively striking the front wall outer surface; and at least two percussion accessories operatively mounted in conjunction with an actuator rod slidably installed so as to extend from the front wall, the actuator rod having at least one actuator spring configured to bias the actuator rod toward the front wall and further configured with an actuator knob positioned on the actuator rod offset from the front wall outer surface, whereby selectively striking the actuator knob temporarily shifts the actuator rod rearwardly against the biasing effect of the actuator spring so as to play the respective percussion accessory.

25. The drum apparatus of claim 24 further comprising two actuator rods, each actuator rod associated with at least one percussion accessory.

* * * * *